US006145570A

United States Patent [19]

Mullet et al.

[11] Patent Number: 6,145,570

[45] Date of Patent: Nov. 14, 2000

[54] LOCKING SYSTEM FOR SECTIONAL DOORS

[75] Inventors: Willis J. Mullet, Pensacola Beach; Harry E. Asbury, Gulf Breeze, both of Fla.

[73] Assignee: Wayne-Dalton Corp., Mt. Hope, Ohio

[21] Appl. No.: 09/169,864

[22] Filed: Oct. 12, 1998

[51] Int. Cl.[7] ..... E05F 15/00

[52] U.S. Cl. ..... 160/191; 160/201

[58] Field of Search ..... 160/201, 189, 160/190, 191, 192, 193, 207, 213, 204

[56] References Cited

U.S. PATENT DOCUMENTS

| | | | |
|---|---|---|---|
| 1,508,886 | 9/1924 | Dautrick et al. . | |
| 1,530,762 | 3/1925 | Dautrick . | |
| 1,994,142 | 3/1935 | Madsen | 20/19 |
| 2,023,909 | 12/1935 | Wread | 268/58 |
| 2,059,833 | 11/1936 | Winn, Jr. | 20/20 |
| 2,091,299 | 8/1937 | Bagley et al. | 160/209 |
| 2,166,746 | 7/1939 | Bartel | 20/20 |
| 2,547,196 | 4/1951 | Clark | 160/201 X |
| 3,096,815 | 7/1963 | May | 160/188 |
| 3,160,200 | 12/1964 | McKee et al. | 160/201 X |
| 3,165,143 | 1/1965 | Jackwig | 160/201 X |
| 3,196,933 | 7/1965 | Schneider | 160/207 |
| 3,231,259 | 1/1966 | Bobrowski et al. | 268/50 |
| 3,258,062 | 6/1966 | Lambert | 160/201 |
| 3,412,780 | 11/1968 | Moler | 160/201 X |
| 3,426,829 | 2/1969 | McDaniel et al. | 160/201 |
| 3,608,612 | 9/1971 | Pemberton | 160/188 |
| 3,764,875 | 10/1973 | Harris | 318/266 |
| 3,980,123 | 9/1976 | Vago | 160/201 |
| 3,996,697 | 12/1976 | Bailey et al. | 49/28 |
| 4,231,191 | 11/1980 | Ellmore | 49/28 |
| 4,472,910 | 9/1984 | Iha | 49/139 |
| 4,520,591 | 6/1985 | Calvagno | 160/193 X |
| 4,538,661 | 9/1985 | Henry et al. | 160/35 |
| 4,637,446 | 1/1987 | McQueen et al. | 160/213 X |
| 4,732,203 | 3/1988 | Alten | 160/188 |
| 4,885,872 | 12/1989 | Chang et al. | 49/362 |
| 4,905,542 | 3/1990 | Burm et al. | 74/625 |
| 4,956,938 | 9/1990 | DeMent | 160/193 X |
| 5,036,899 | 8/1991 | Mullet | 160/189 |
| 5,533,561 | 7/1996 | Forehand | 160/201 X |
| 5,544,924 | 8/1996 | Paster | 160/201 X |
| 5,698,073 | 12/1997 | Vincenzi | 160/188 |

*Primary Examiner*—David M. Purol

*Attorney, Agent, or Firm*—Renner, Kenner, Greive, Bobak, Taylor & Weber

[57] ABSTRACT

A locking system (10, 110, 210) for a sectional overhead door (11) powered through a counterbalance system (30) including, a flexible member (C) interconnecting the counterbalance system and the door and providing tensioning during opening and closing of the door, a movable stop (50, 150, 250) selectively actuatable to a locked position precluding movement of the door, and a biasing member (65, 165, 255) urging the movable stop toward the locked position, whereby in the event of slack in the flexible member the biasing member displaces the movable stop to the locked position.

16 Claims, 10 Drawing Sheets

LOCKING SYSTEM FOR SECTIONAL DOORS

TECHNICAL FIELD

The present invention relates generally to a locking system for sectional overhead doors. More specifically, the present invention relates to a locking system for a sectional overhead door that is powered through the counterbalance system. More particularly, the present invention relates to a self-actuating locking system for a sectional overhead door that is powered through a counterbalance system having flexible members effecting interconnection with the door.

BACKGROUND ART

Sectional overhead doors have long been employed in both residential structures and commercial and industrial buildings. Such sectional overhead doors are normally designed not only to protect a garage or commercial establishment from the elements, such as rain, snow, wind, and temperature extremes, but also to provide security for a residence or commercial establishment. In this respect, sectional doors are virtually universally provided locking systems so that when such a door is in the closed position, it may be locked to prevent the entry or departure of unauthorized persons.

In the past, the locking systems for sectional overhead doors have primarily involved two types of systems, i.e., manual and motorized. For the most part, manual systems are employed when the sectional overhead door is not controlled by a powered or motorized operator. Such locking systems have effected the locking function in a number of different ways. In general, manual locking systems are normally activated by a handle mounted on the exterior surface of the door, often with redundant handles on the interior surface of the door that activate sliding bars, cables, or the like, which interact with either the track system for the door or a specially configured strike, which is attached to the doorjambs, commonly proximate to the track system for the door. These locking systems normally employ levers that attach to a lock disk, which is manually rotatably actuated to effect the locking and unlocking functions. In many instances, a lock mechanism has been incorporated or positioned in operative relation to the lock handle or lock disk, such as to preclude actuation of the lock system in the locked position without a key or other entry device. In some instances, these locking systems have been spring loaded so that the door locks automatically when closed and can be unlocked manually. These conventional locking systems have been commonly known for many years and employ a variety of bars, rods, and the like, together with associated mounting hardware, to carry out the desired locking function, usually at both ends of the sectional overhead door. Most of these prior-art manual systems require numerous additional hardware components, such as handles, lock disks, lock bars, strikes, catches, and other components, which add substantial expense, increase the weight of the door, require installation and adjustment on site, and, as a result, are necessarily relatively expensive.

Variations of these conventional manual locking systems include locks that are positioned at the top of the door for manual actuation to move a stop or roller out of alignment with the top of a door to effect unlocking. In some instances, solenoid actuated locks have been employed to actuate various locking devices in lieu of a handle attached to the door requiring manual actuation. In other instances, actuating devices for doors, such as cables leading to displaced locations, may interface with a locking device, such that when the manually operated cable controlling the raising and lowering of the door is actuated, the locking device is deactivated to permit the door to raise or lower. Any security features in systems of this nature require the utilization of a separate locking system in conjunction with the handle for actuating the cable operator.

The second type of locking system, which has become increasingly employed in recent years, contemplates that the door be rigidly or otherwise interconnected with a motorized operator that effects the raising and lowering of the door. The most common of the motorized operator locking systems employ a draw bar or arms that interconnect a location on the top section of the sectional overhead door and a motorized screw or chain drive system that is fixedly mounted above the door. In systems of this type, the chain or drive screw is driven to a position, such that the draw bar or arms are preferably in proximity to and aligned with the plane of the door when the door is in the closed position. In this manner, any attempt to raise the door from the closed position is blocked by the rail of the operator housing the screw or chain, which is located above and perpendicular to the plane of the door.

Another type of motorized operator uses a closed loop system wherein there are pulleys and cables that both pull-up and pull-down of the door to effect its closing and opening motions. Other operator systems have proposed the usage of motor-driven gears on the door edges that engage a slotted track system to effect opening and closing of the door and require actuation of the drive system to move the door from the closed position. While each of these motorized systems may provide security features, none have achieved wide acceptance in the industry due to the complexity, cost, and other factors.

DISCLOSURE OF THE INVENTION

Therefore, an object of the present invention is to provide a locking system for a sectional overhead door that is self-actuating when the door is raised from the closed position without energizing the operator, as in the instance of an attempted forced entry. Another object of the present invention is to provide such a locking system that is operative in installations wherein the door is powered through the counterbalance system, such that the operator is not directly connected to the door, as is the case in most motor-operated systems for raising and lowering sectional overhead doors. A further object of the present invention is to provide such a locking system that is actuated by the presence of slack in cables or other flexible members that are operated to open and close the door. Still another object of the present invention is to provide such a locking system where the operator controls rotation of the counterbalance system when the door is proximate to the closed position, and the drive tube of the counterbalance system is rotationally locked when the door is in the closed position, as in the instance of a jack-shaft type operator.

Another object of the present invention is to provide a locking system for a sectional overhead door which is a passive system that does not require a person to do any affirmative manual acts to lock or unlock the door when it is used with a jack shaft operator. Yet a further object of the present invention is to provide such a locking system that further requires no resetting or operative steps after the lock has been actuated in that returning the door to the closed position deactivates the locking system. Still another object of the invention is to provide such a locking system that locks only when the door is proximate to the closed position and the door is opened slightly, as in the instance of an attempted forced entry.

A further object of the present invention is to provide a locking system for a sectional overhead door having a stop member that is movable to physically block opening of the door when it is moved upwardly from the closed position. Yet another object of the present invention is to provide such a locking system employing a hinged stop plate that is pivotally positioned by a spring and a flexible member that overrides the spring to move the stop plate from a position obstructing upward movement of the door to a retracted position. Still a further object of the present invention is to provide such a locking system having a stop plate rotatably mounted on a pivot pin, with a positioning pin thereon for engaging the flexible member and a stop pin for selectively engaging and disengaging the door, depending upon the interaction of a flexible member or cable with the positioning pin. Still a further object of the invention is to provide such a locking system employing a crimped sleeve attached to a flexible member or cable that selectively engages a fixed lock bracket attached to the doorjamb as actuated by a spring to effect locking of the door.

Yet a further object of the present invention is to provide a locking system for a sectional overhead door that does not require additional hardware, such as handles, lock bars, or the like, that requires holes in the door, and can add sufficient weight to the door, such as to require an enhanced counterbalance system. Yet another object of the invention is to provide such a locking system that cannot damage the door if a person forgets to unlock the door prior to activating a motorized operator for the door and where the door cannot be damaged during actuation of the locking function, as may occur in the instance of trolley-type operators where the trolley may continue to drive after passing over the locked position. Yet another object of the invention is to provide such a locking system that does not require keys, combinations, or the like, which may be lost or forgotten. Yet a further object of the present invention is to provide such a locking system that has a minimum number of moving parts, which can be easily installed, which can be retrofit on existing doors, and which is relatively low cost.

In general, the present invention contemplates a locking system for a sectional overhead door powered through a counterbalance system including, a flexible member interconnecting the counterbalance system and the door and providing tensioning during opening and closing of the door, a movable stop selectively actuatable to a locked position precluding movement of the door, and a biasing member urging the movable stop toward the locked position, whereby in the event of slack in the flexible member the biasing member displaces the movable stop to the locked position.

PREFERRED EMBODIMENT FOR CARRYING OUT THE INVENTION

Figure 1:
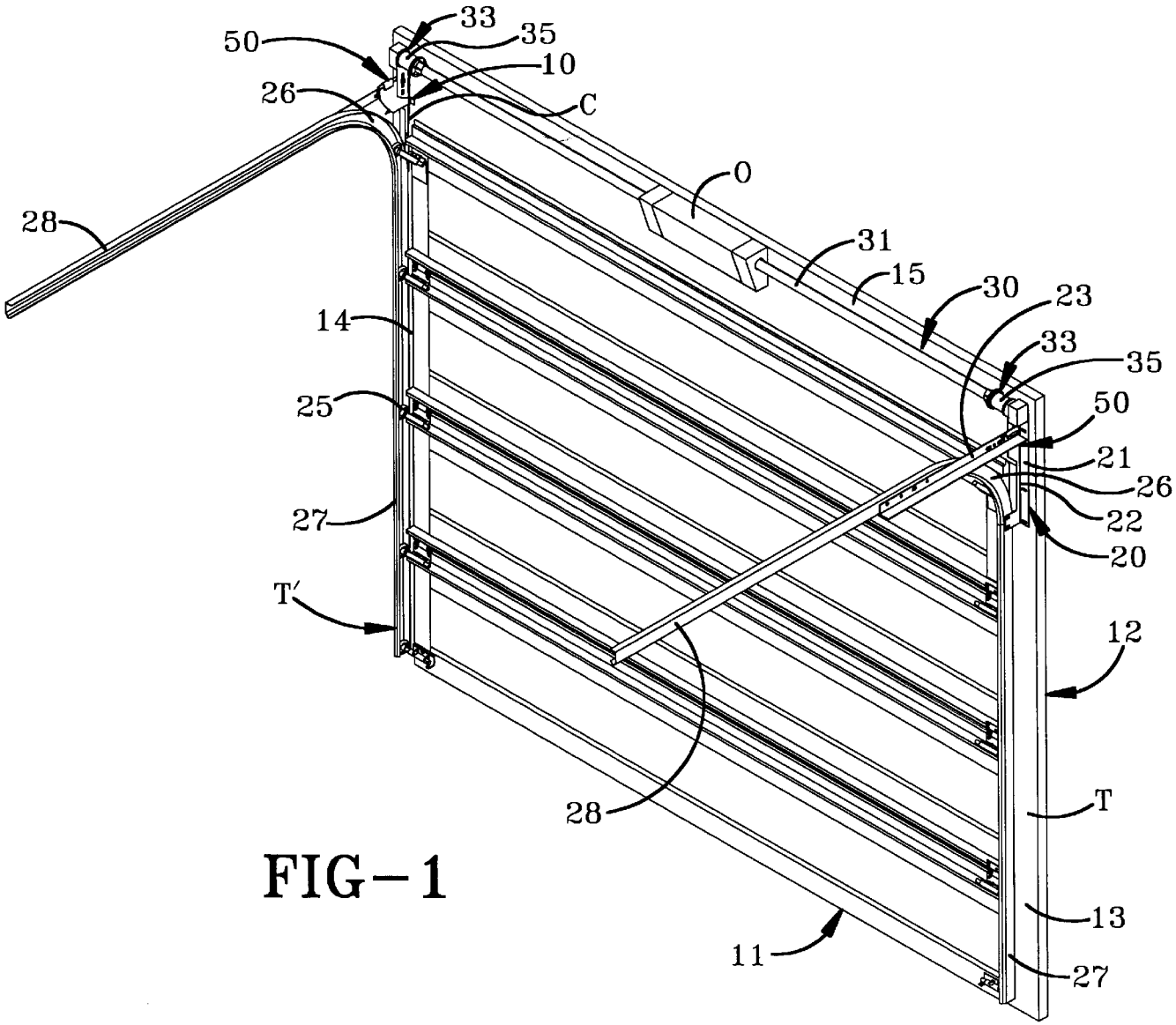
FIG. 1 is a perspective view of an exemplary sectional overhead door having a motor-driven counterbalance system suitable for utilization with a locking system according to the concepts of the present invention.
Figure 2:
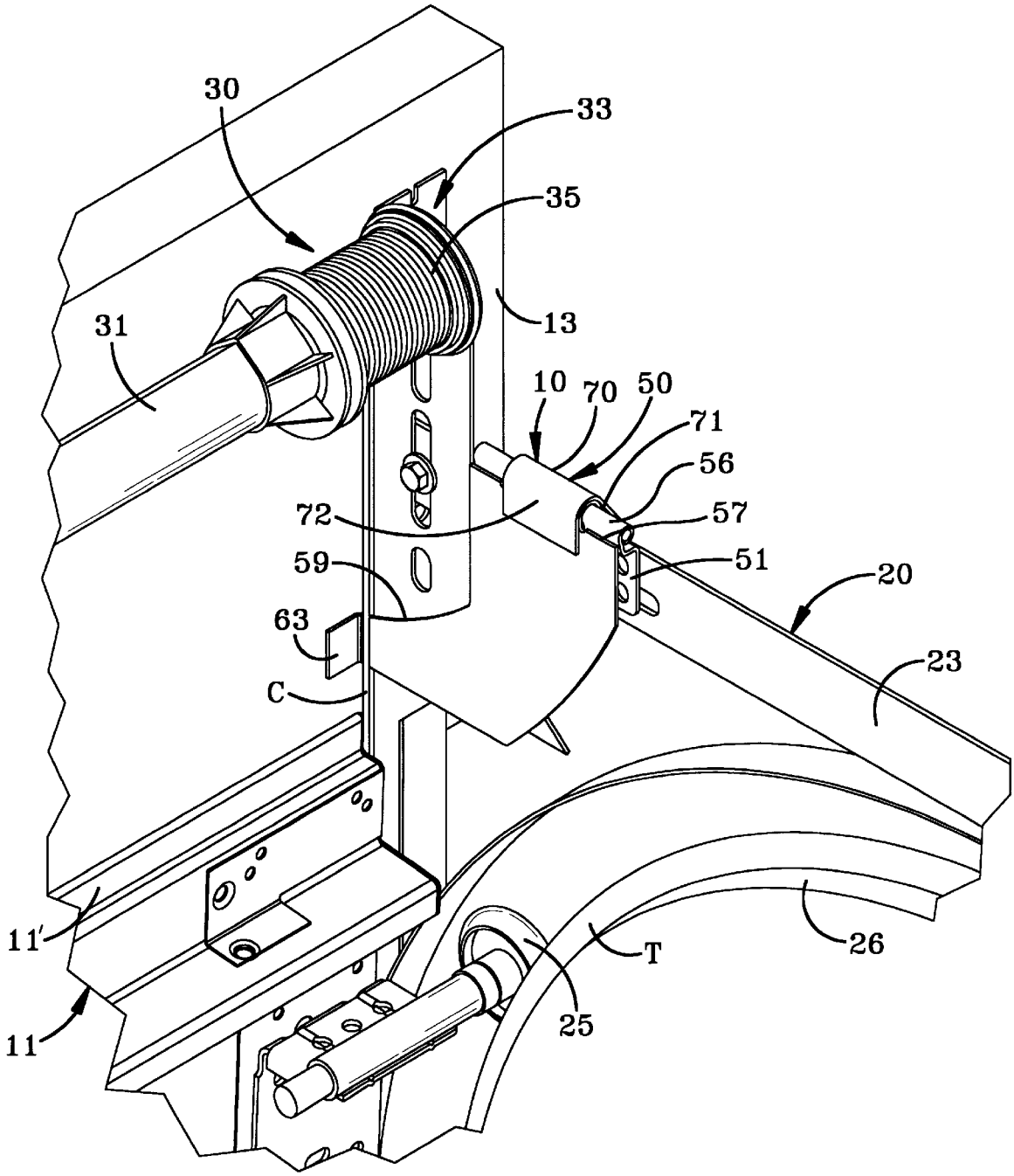
FIG. 2 is an inside perspective view of a locking mechanism according to the concepts of the present invention shown in conjunction with a sectional overhead door powered through the counterbalance system according to FIG. 1, with the counterbalance system tension cable and a movable stop of the locking system in their retracted position.

A locking system according to the concepts of the present invention is generally indicated by the numeral 10 in FIGS. 1–4 of the drawings. Referring to FIG. 1 of the drawings, the cable control device 10 is shown mounted in conjunction with a conventional sectional door, generally indicated by the numeral 11, of a type commonly employed in garages for residential housing. The opening in which the door 11 is positioned for opening and closing movements relative thereto is defined by a frame, generally indicated by the numeral 12, that consists of a pair of spaced jambs 13, 14 that, as seen in FIG. 1, are generally parallel and extend vertically upwardly from the floor (not shown). The jambs 13, 14 are spaced and joined at their vertically upper extremity by a header 15 to thereby delineate a generally inverted U-shaped frame 12 around the opening of the door 11. The frame 12 is normally constructed of lumber, as is well known to persons skilled in the art, for the purposes of reinforcement and facilitating the attachment of elements supporting and controlling door 11.

Affixed to the jambs 13, 14 proximate the upper extremities thereof and the lateral extremities of the header 15 to either side of the door 11 are flag angles, generally indicated by the numeral 20. The flag angles 20 generally consist of L-shaped, vertical leg members 21 having a leg 22 attached to underlying jambs 13,14, and a projecting leg 23 preferably disposed substantially perpendicular to the leg 22 and, therefore, perpendicular to the jambs 13, 14.

The projecting legs 23 are positioned in supporting relation to tracks T, T' located to either side of door 11. The tracks T, T' provide a guide system for rollers 25 attached to the side of door 11 in a manner well known to persons skilled in the art. The projecting legs 23 normally extend substantially perpendicular to the jambs 13, 14 and may be attached to a transitional portion 26 of tracks T, T' between a vertical section 27 and a horizontal section 28 thereof or to horizontal section 28 of tracks T, T'. The tracks T, T' define the travel of the door 11 in moving upwardly from the closed to open position and downwardly from the open to closed position.

Still referring to FIG. 1 of the drawings, door 11 has a counterbalance system, generally indicated by the numeral 30. As shown, the counterbalance system 30 includes an elongate drive tube 31 extending between cable drum mechanisms 33 positioned proximate each of the flag angles 20. While the exemplary counterbalance system 30 depicted herein is advantageously in accordance with U.S. Pat. No. 5,419,010, which is incorporated herein by reference, it will be appreciated by persons skilled in the art that any of a variety of torsion-spring counterbalance systems could be employed. In any instance, the counterbalance system 30 includes cable drum mechanisms 33 positioned on the drive tube 31 or a shaft proximate the ends thereof which rotate with drive tube 31. The cable drum mechanisms 33 each have a cable C reeved thereabout which is affixed to the door 11, preferably proximate the bottom, such that rotation of the cable drum mechanisms 33 operates to open or close the door 11. The cable C may be attached to a substantially cylindrical drum 35 of cable drum mechanism 33 in the manner described in the aforesaid U.S. Pat. No. 5,419,010. The cable C is preferably a conventional stranded steel cable, which may be coated and, due to its memory characteristics, has a tendency to resist bending in the absence of tension forces acting thereon. The counterbalance system 30 has an operator 0, which may conveniently enclose a length of the drive tube 31, as shown, or be a typical jack-shaft operator connected by gears, pulleys, or the like to selectively rotatably power the drive tube 31 or a shaft in a manner well known to persons skilled in the art.

The locking system 10 is operatively positioned in relation to the door 1, as detailed in FIGS. 2, 3A, 3B, and 4. The locking systems 10 each have a locking mechanism, generally indicated by the numeral 50, mounted on the projecting leg 23 of each of the flag angles 20. While it is preferred to provide a locking mechanism 50 in conjunction with each of the flag angles 20 at the lateral extremities of door 11, a single locking mechanism 50 might be provided in certain instances. Since the locking mechanisms 50 may be identical except that each is the mirror image of the other, only the locking mechanism 50 provided at the right-hand side of door 11, as viewed in FIG. 1, is described in detail hereinafter.

The locking mechanism 50 has a hinge leaf 51 that is attached to the leg 23 of flag angle 20 as by spot welds, screws, or other appropriate fasteners (not shown). The hinge leaf 51 has an outwardly projecting cylindrical knuckle 52 that preferably extends above and inwardly of the leg 23 of the flag angle 20 (see FIGS. 3A and 3B).

The locking mechanism 50 has a stop plate 55 operatively interrelated with the hinge leaf 51. In particular, the stop plate 55 has a projecting knuckle 56 along its upper edge 57. Projecting knuckle 56 overlies and is freely pivotally mounted on the cylindrical knuckle 52 of the hinge leaf 51. The stop plate 55 has a front edge 58 and a rear edge 59 that are cut away or contoured such as to provide a stop plate 55 having suitable rigidity and permitting outward and upward pivoting of stop plate 55 relative to hinge leaf 51 in the manner seen in comparing FIGS. 3A and 3B without interfering engagement with the tracks T or other components of the door 11 and its operating systems.

Figure 3B:
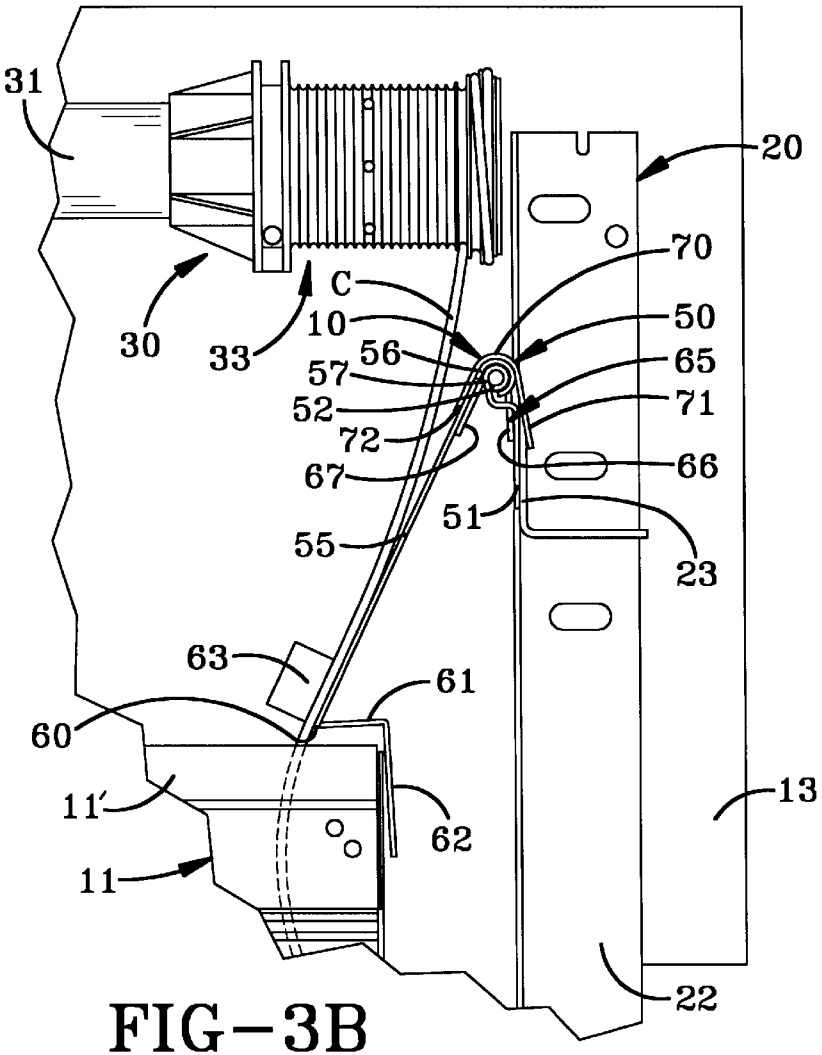
FIG. 3B is an elevational view of the locking system of FIG. 2 showing the counterbalance system tension cable in a slack condition and the movable stop of the locking system in the locked position, obstructing upward movement of the door.

The stop plate 55 has, at its lower edge 60, an offset surface 61 (see FIGS. 3A and 3B) that is adapted to move into and out of engagement with top bracket 11' of the door 11, as seen in the drawings. For purposes of effecting substantially flush contact between offset surface 61 of stop plate 55 and upper surface of top bracket 11', the offset surface 61 is preferably angled so as to substantially parallel the top edge of top bracket 11', as best seen in FIG. 3B. The edge of offset surface 61 opposite lower edge 60 of stop plate 55 forms a down turned retainer surface that engages the edge of door 11. Stop plate 55 is in the blocking or door-restraining position when located as depicted in FIG. 3B. The retainer surface 62 is preferably substantially perpendicular to offset surface 61, such as to encompass the upper comer of the door 11 and particularly the top bracket 11'. It will thus be apparent that with the stop plate 55 of locking mechanism 50 in the position depicted in FIG. 3B, upward movement of the door 11 will be positively mechanically precluded by offset surface 61 engaging the upper surface of top bracket 11'. Further, excessive pivoting of the stop plate 55 is restrained by retainer surface 62 of stop plate 55.

The stop plate 55 of locking mechanism 50 has a projecting guide 63, which is preferably located proximate the lower edge 60. The guide 63 projects at substantially right angles to the plane of stop plate 55 for purposes of retaining the cable C in contact with stop plate 55 when there is slack in the cable C, as depicted in FIG. 3B. This assures that when tension is reestablished in cable C, as by lowering the door 11 to the fully closed position, the tensioning of cable C will move stop plate 55 from the locking position to the retracted position depicted in FIG. 3A.

The stop plate 55 is continually biased toward the locked position depicted in FIG. 3B by a leaf spring 65. The leaf spring 65 has a first arm 66 engaging the inner surface of hinge leaf 51 and a second arm 67 engaging interiorly of the stop plate 55 to thereby bias stop plate 55 outwardly from hinge leaf 51 due to pivoting action about the hinge knuckles 52, 56.

Figure 3A:
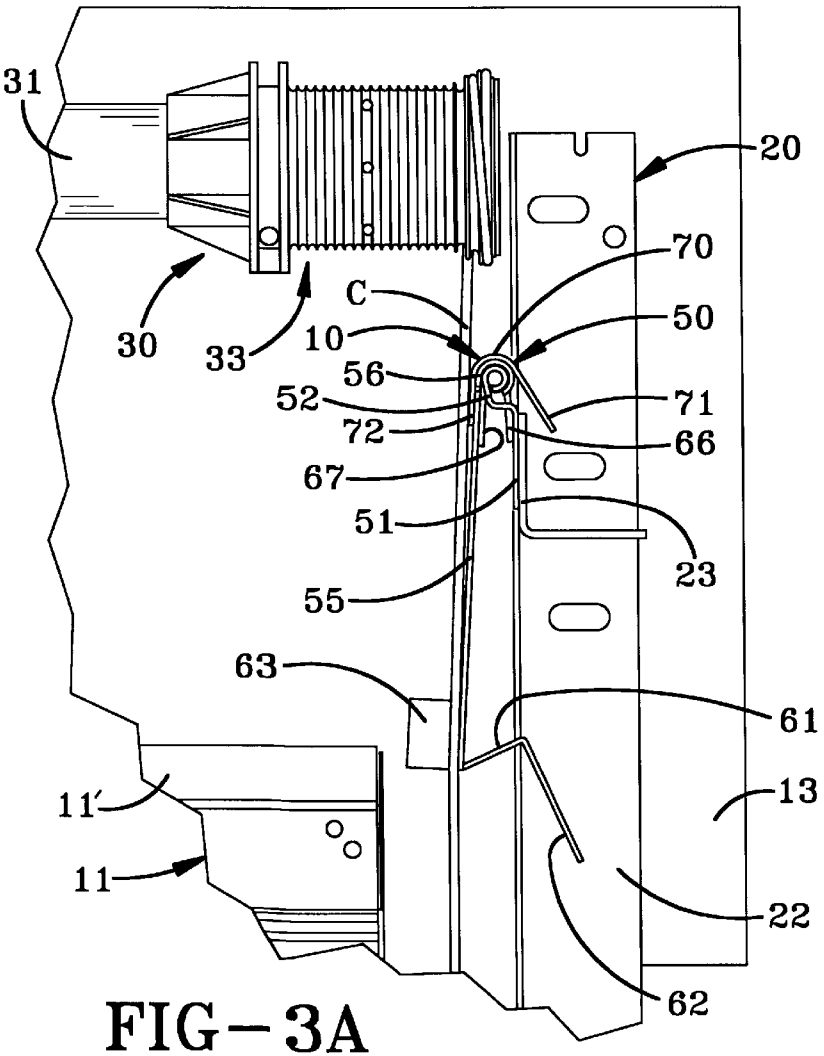
FIG. 3A is an elevational view of the locking system depicted in FIG. 2, with the movable stop in the retracted position.
Figure 4:
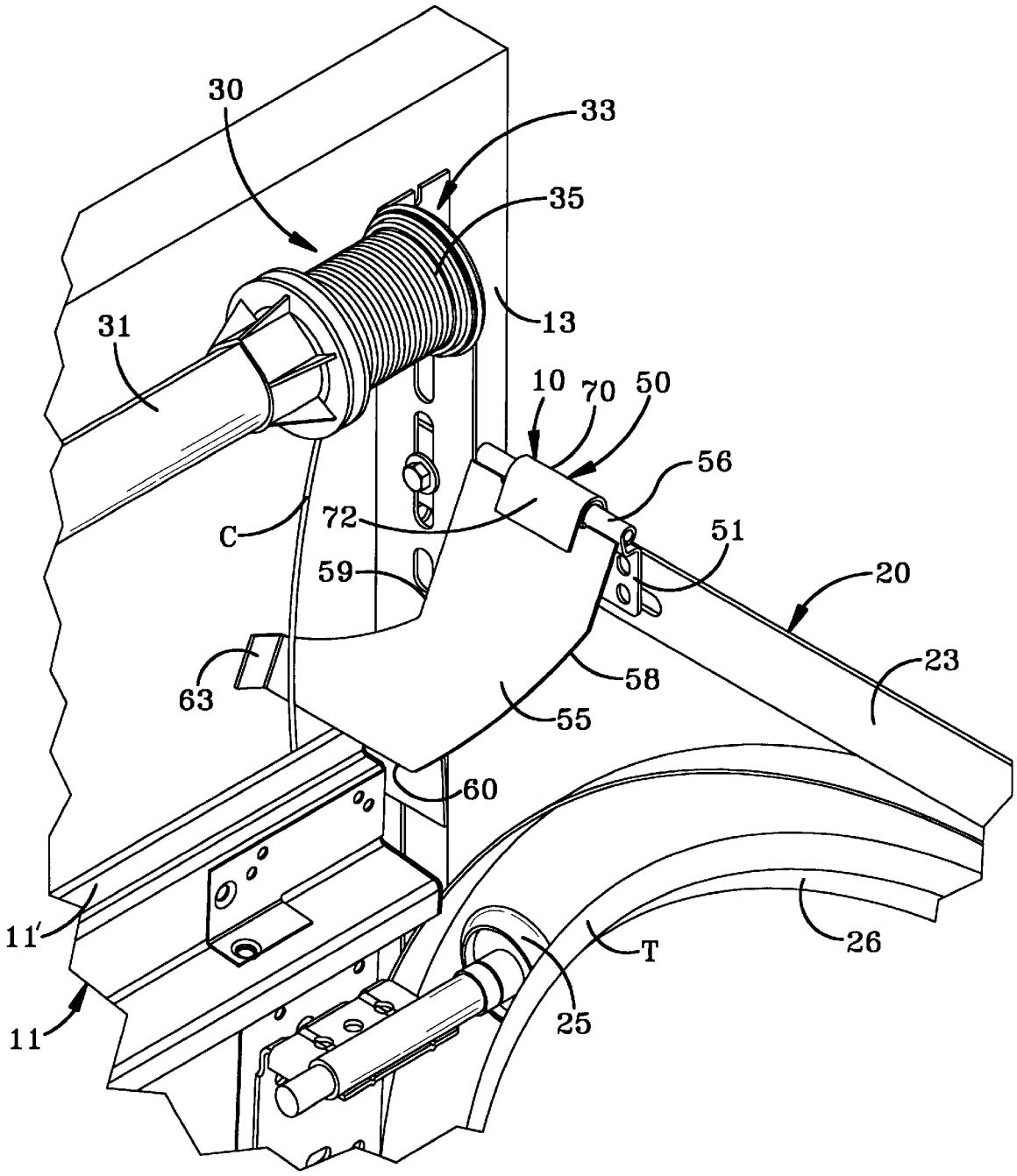
FIG. 4 is a perspective view of the locking system of FIG. 2 showing the counterbalance system tension cable in a slack condition and the movable stop in the locked position, obstructing upward movement of the door.

The extent of pivotal movement of stop plate 55 of locking mechanism 50 relative to hinge leaf 51 is separately controlled by an angle clamp 70. As seen, the angle clamp 70 overlies the area of knuckles 52, 56 and particularly has a first leg 71 that overlies projecting leg 23 of flag angles 20 and a second leg 72 that overlies the upper portion of stop plate 55. The angle clamp 70 has the legs 71, 72 at a predetermined fixed angle, such as to permit pivotal action of stop plate 55 relative to hinge leaf 51 to substantially between the retracted and locking positions of stop plate 55, as depicted in FIGS. 3A and 3B, respectively. The angle clamp 70 is of significance in instances where the cable C may become slack when the door 11 is in the open, horizontal position, such that the door 11 is not in a position to block angular outward motion of the stop plate 55 relative to hinge leaf 51. In such instance, the stop plate 55 is displaced to retain contact with the cable C; however, extreme angular displacement of stop plate 55, which could inordinately displace cable C relative to cable drum mechanism 33, is avoided.

Figure 5:
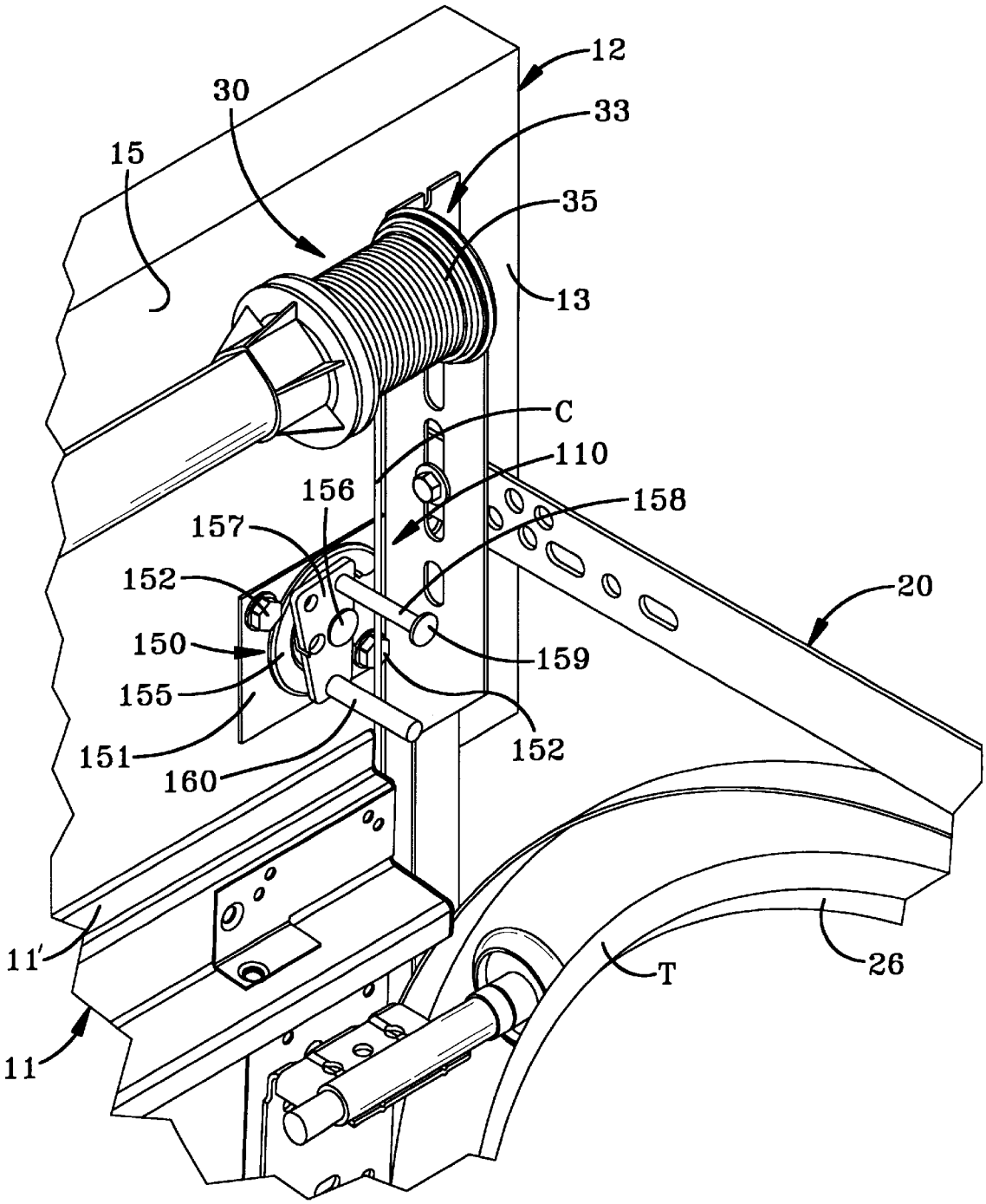
FIG. 5 is an inside perspective view of an alternate form of locking system for a motor-driven counterbalance system for a sectional door depicting a movable stop in a retracted position relative to the door.
Figure 6:
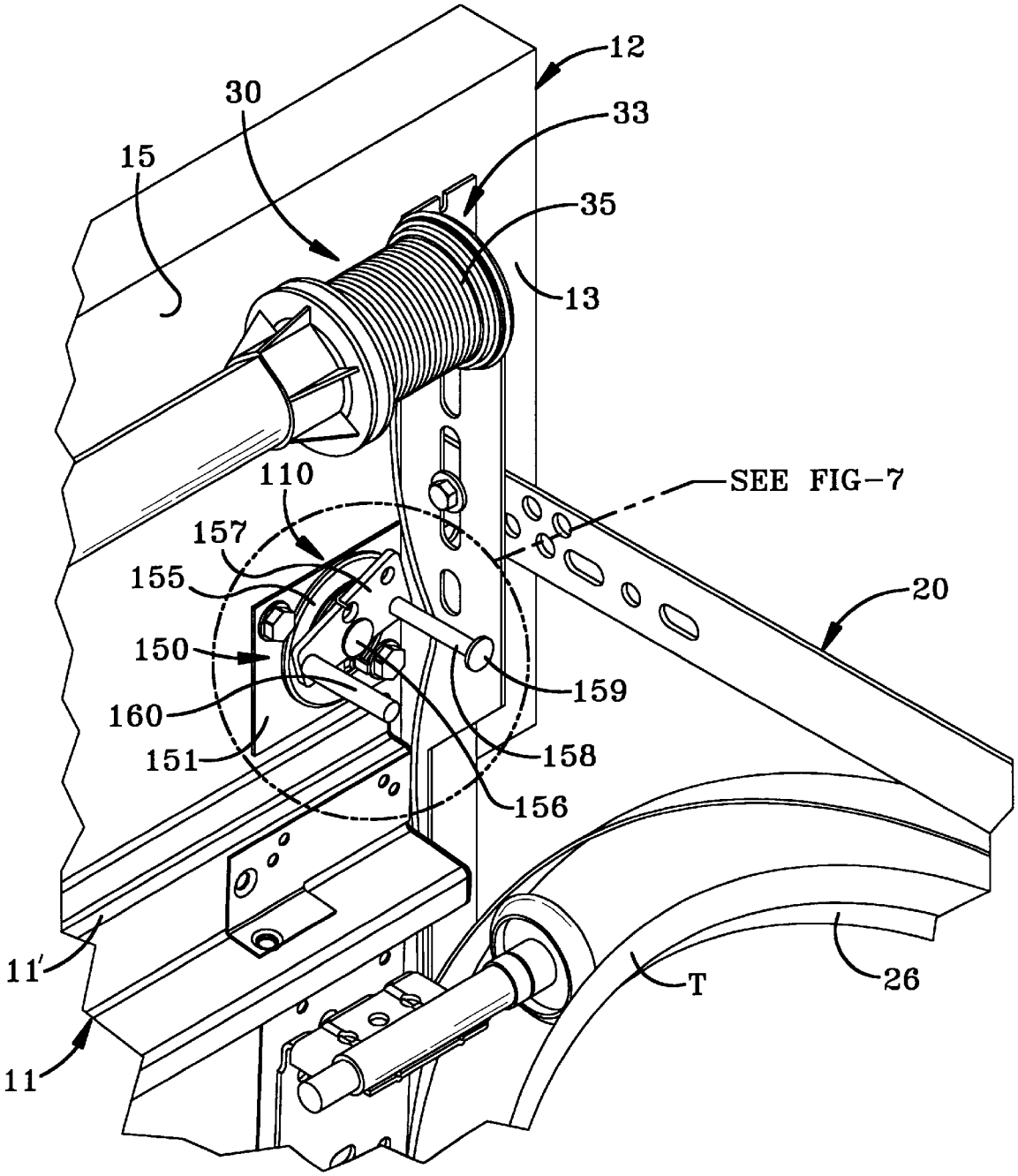
FIG. 6 is an enlarged perspective view similar to FIG. 5 depicting the movable stop in engagement with the door when the cable of the counterbalance system is in a slack condition.
Figure 7:
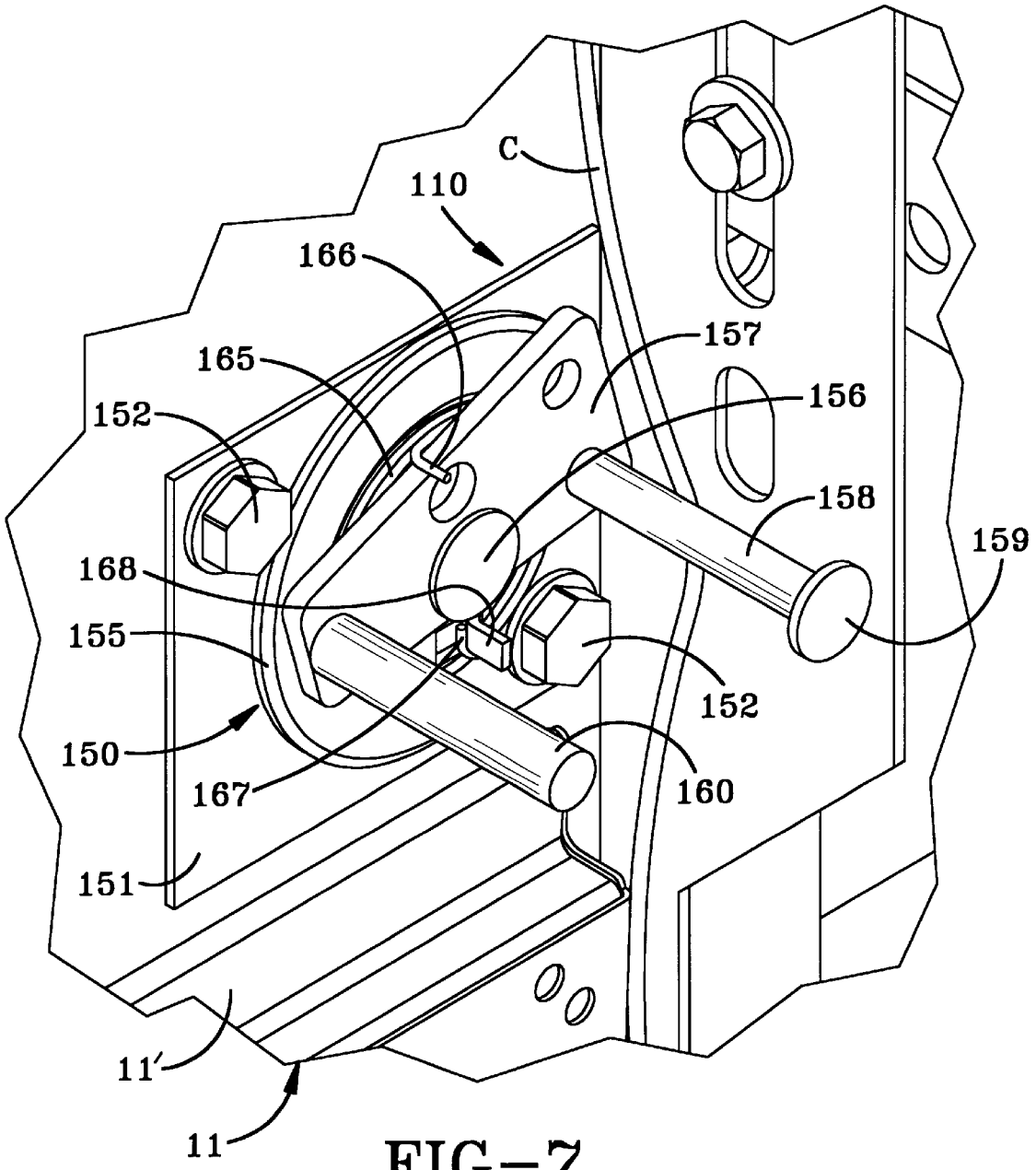
FIG. 7 is an enlarged perspective view showing details of the structure of the movable stop for the locking system depicted in FIG. 6 of the drawings.

An alternate form of locking system, generally indicated by the numeral 110, is shown operatively positioned in relation to the door 11 in FIGS. 5–7 of the drawings. The locking systems 110 each have a locking mechanism, generally indicated by the numeral 150, mounted on the header 15 of the frame 12 a distance above and laterally to the side of the door 11 when it is in the closed position, as depicted in FIG. 5 of the drawings. While in certain instances a single locking mechanism 150 might be provided at one end of door 11, it is preferred to provide a locking mechanism 150 at each end of door 11. Since identical structure may be provided, only the locking mechanism 150 at the right hand side of door 11, as viewed in FIG. 1, is described in detail hereinafter.

The locking mechanism 150 has a mounting plate 151 that may be attached to the header 15 of door frame 12 as by screws 152 or other appropriate fasteners. The mounting plate 151 has an upstanding spring housing 155 extending outwardly thereof. A pivot pin 156 is mounted centrally of the spring housing 155. The pivot pin 156 rotatably mounts a stop plate 157, which is retained between the head of pivot pin 156 and the spring housing 155.

The stop plate 157 of locking mechanism 150 has a positioning pin 158 that engages the cable C of the counterbalance system 30. The positioning pin 158 may have an enlarged head 159 that, with the surface of stop plate 157, assists the positioning pin 158 to maintain contact with the cable C, even with the presence of slack in cable C, as seen in FIG. 7. In addition to positioning pin 158, stop plate 157 mounts a projecting stop pin 160, which is preferably positioned on stop plate 157 to the opposite side of pivot pin 156 from the positioning pin 158. The stop pin 160 engages the top bracket 11' of the door 11, as seen in FIG. 7, as the door 11 is raised from the closed position a sufficient distance to create slack in cable C, as depicted in FIGS. 6 and 7.

The stop plate 157 is urged to the locked position depicted in FIGS. 6 and 7 by a torsion spring 165 mounted within spring housing 155 of mounting plate 151, as best seen in FIG. 7. As can be seen, the spring 165 is designed and positioned such that one end 166 thereof engages the stop plate 157, and the second end 167 engages a projecting tab 168 associated with the mounting plate 151. It will be appreciated that with slack in cable C, the torsion spring 165 is essentially untensioned, and the stop plate 157 is positioned substantially as viewed in FIG. 7, with the door raised slightly from its closed position. Any further raising of the door 11 from the locked position of FIG. 7 rotates stop plate 157 into engagement with the head of screw 152, thereby causing stop pin 160 to retard any further raising of the door 11.

When the door 11 is lowered to the fully closed position, all slack is removed from the cable C, which, due to its engagement with positioning pin 158, rotates stop plate 157 counterclockwise to the position depicted in FIG. 5. In this retracted position, with the positioning pin 158 and stop pin 160 substantially vertically aligned, as seen in FIG. 5, the door 11 may be raised in conventional fashion by the operator O through counterbalance system 30 without interference from locking mechanism 150, which is in the retracted position of FIG. 5.

Figure 8:
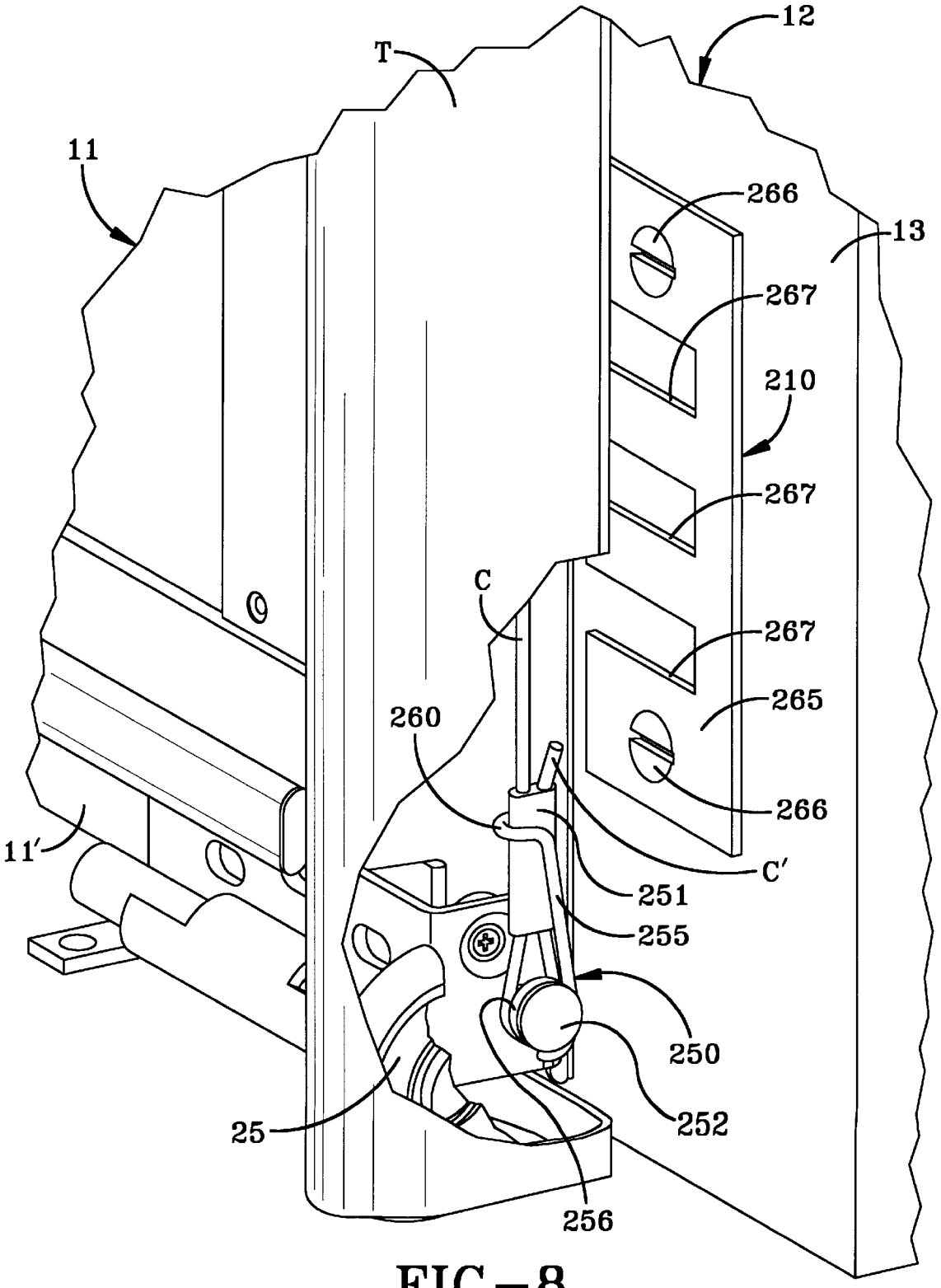
FIG. 8 is an outside perspective view with track portions broken away showing an alternate form of locking system for a sectional overhead door having a motor-driven counterbalance system with a movable stop in the retracted position and the cable of the counterbalance system in a tensioned condition.
Figure 9:
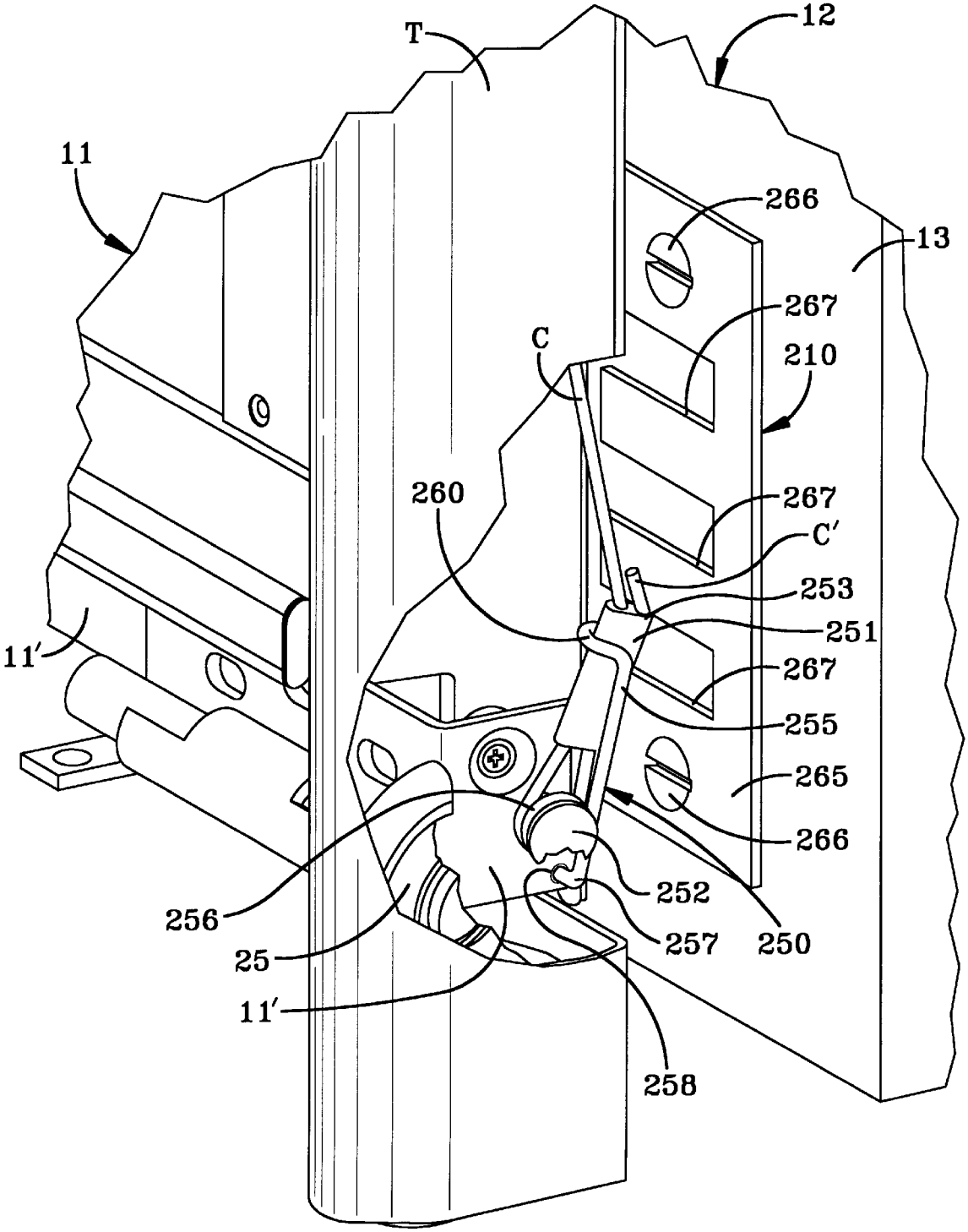
FIG. 9 is an enlarged perspective view similar to FIG. 8 depicting the locking system of FIG. 8 in the locked position due to the slack condition of the cable of the counterbalance system.
Figure 10:
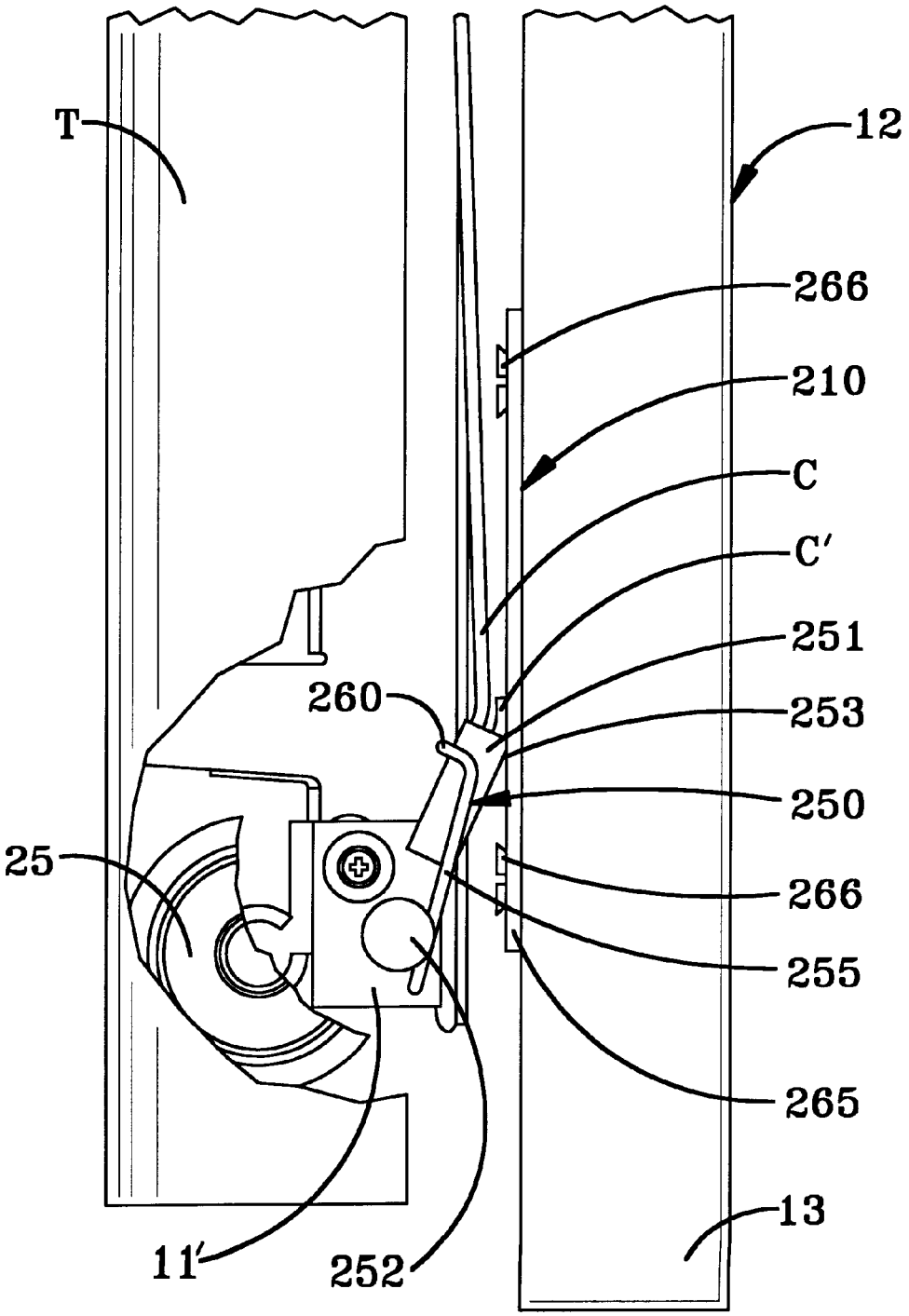
FIG. 10 is a side-elevational view of the locking system of FIGS. 8 and 9 showing the movable stop in the locked position, together with additional details of the structure of the movable stop.

Another alternate form of locking system, generally indicated by the numeral 210, is shown operatively positioned in relation to the door 11 in FIGS. 8–10 of the drawings. The locking systems 210 each have a locking mechanism, generally indicated by the numeral 250, mounted on the cable C proximate the lower edge of the door 11. While in certain instances a single locking mechanism 250 might be provided at one end of door 11, it is preferred to provide a locking mechanism 250 at each end of door 11. Since identical structure may be provided, only a locking mechanism 250 at the right-hand side of door 11, as viewed in FIG. 1, is described in detail hereinafter.

The locking mechanism 250 has a clamp or crimped sleeve 251 that is attached to the cable C. The crimped sleeve 251 may be employed in conventional fashion to secure the lower portion C' of cable C to a conventional milford pin 252 attached to the bottom bracket 11' of the door 11. As can be seen in FIGS. 8–10, lower portion C' of the cable C encircles the milford pin 252, is placed within the clamp or sleeve 251, and the clamp or sleeve 251 is crimped in one or more locations to permanently lock the clamp or sleeve 251 on the lower portion C' of the cable C. As can noted from the drawings, the crimped sleeve 251 is placed on lower portion C' of cable C in such a manner that lower portion C' cannot be readily displaced from the milford pin 252 but is capable of free rotation with the sleeve 251 about the milford pin 252. Positioning of the sleeve 251 is controlled by the cable C when it is tensioned in the normal operating sequence of the door 11.

The locking mechanism 250 of locking system 210 also includes a torsion spring 255 that interacts with the door 11 and the crimped sleeve 251 on the cable C. The spring 255 preferably has a coil 256 that maintains the spring 255 on the milford pin 252 in operative relation thereto. The spring 255 has an angled end 257 that is permanently anchored in a hole 258 (see FIG. 9) in the bottom bracket 11' of door 11. The other extremity of spring 255 is a curved end 260 preferably adapted to conform to and retentively engage the sleeve 251. As will be appreciated from FIGS. 9 and 10, the spring 255 is configured to continually bias the sleeve 251 and lower portion C' of cable C toward the jamb 13 of frame 12.

Upward or opening movement of door 11 is precluded when the cable C is slack by the engagement of sleeve 251 with a lock bracket 265 constituting a portion of locking system 210. As shown, the lock bracket 265 is a substantially rectangular plate that is mounted on outward side of jamb 13 facing the track T. The lock bracket 265 can be attached to jamb 13 as by screws 266 or other suitable fasteners. The lock bracket 265 has one or more lateral slots 267 that may be vertically spaced and aligned along the lock bracket 265. As can be readily perceived from FIGS. 9 and 10 of the drawings, the incidence of slack in cable C, as when door 11 may be lifted from the closed position without actuating the operator 0, causes the locking mechanism 250, and particularly the crimped sleeve 251, as urged by spring 255 into engagement with the lock bracket 265. The crimped sleeve 251, and particularly its upper edge 253, engages one of the lateral slots 267 in lock bracket 265 to thereby positively restrain further upward motion of the door 11. When the door 11 is subsequently lowered to the fully closed position, tension is resumed in the cable C, which returns the locking system 210 to its normal operating position depicted in FIG. 8.

Thus, it should be evident that the locking system for sectional doors disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. A door operating system comprising, a sectional overhead door, a counterbalance system having a drive tube and drum mechanism, an operator interconnected with said drive tube for powering said door between a closed position and an open position, a flexible member interconnecting said drum mechanism of said counterbalance system and said door and tensioned during opening and closing of the door, a movable stop selectively actuatable to a locked position engaging said door such as to preclude any substantial extent of upward movement of said door from said closed position, and a biasing member positively urging said movable stop toward said locked position, whereby in the event of slack in said flexible member induced by upward movement of said door from said closed position independent of said drive tube said biasing member displaces said movable stop to said locked position.

2. A door operating system according to claim 1, wherein said biasing member is a spring.

3. A door operating system according to claim 1, wherein said flexible member is a cable.

4. A door operating system according to claim 1, wherein said movable stop is pivotally mounted.

5. A door operating system according to claim 4, wherein said movable stop has a rigidly mounted hinge member with a stop plate pivotally attached to said hinge member and movable between said locked position engaging the door and a retracted position.

6. A door operating system according to claim 5, wherein said biasing member is a leaf spring interposed between said hinge member and said stop plate.

7. A door operating system according to claim 4, wherein said movable stop has a projecting guide adapted to retain said flexible member in contact with said movable stop.

8. A door operating system according to claim 4, wherein said movable stop has an offset surface for engaging the top of the door when in said locked position and a retainer surface for engaging a side of the door when in said locked position.

9. A door operating system according to claim 4, wherein said movable stop has an angle clamp for limiting pivotal movement of said movable stop.

10. A door operating system comprising a sectional overhead door, a counterbalance system having a drive tube and drum mechanism, an operator interconnected with said drive tube for powering said door between a closed position and an open position, a flexible member interconnecting said drum mechanism of said counterbalance system and said door and tensioned during opening and closing of the door, a movable stop means selectively actuatable to a locked position engaging said door such as to preclude any substantial extent of upward movement of said door from said closed position, and biasing means for positively urging said movable stop means from a retracted position toward said locked position, whereby in the event of slack in said flexible member induced by upward movement of said door only from said closed position independent of said drive tube said biasing means displaces said movable stop means to said locked position.

11. A door operating system according to claim 10, wherein said biasing means is a spring.

12. A door operating system according to claim 10, wherein said movable stop means is a stop plate having means for contacting said flexible member and means for obstructing movement of the door.

13. A door operating system comprising a sectional overhead door having a top bracket, a counterbalance system having a drive tube and a drum mechanism, an operator interconnected with said drive tube for powering said door between a closed position and an open position with said drive tube locked by said operator when the door is in the closed position, a flexible member interconnecting said drum mechanism of said counterbalance system and said door and normally tensioned during opening and closing of the door, a movable stop positioned to selectively engage and disengage said top bracket of said door, and a biasing member urging said movable stop into engagement with said flexible member and toward engagement with said top bracket of said door, whereby in the event of slack in said flexible member said biasing member displaces said movable stop into engagement with said top bracket to obstruct movement of the door from said closed position toward said open position.

14. A door operating system according to claim 13, wherein said movable stop is pivotally mounted.

15. A door operating system according to claim 13, wherein said movable stop has a rigidly mounted hinge member with a stop plate pivotally attached to said hinge member and movable between said locked position engaging said door and a retracted position.

16. A door operating system according to claim 13, wherein said movable stop is mounted in a fixed position proximate said top bracket of said door when said door is in said closed position.

* * * * *